United States Patent [19]

Grant et al.

[11] Patent Number: 4,606,498

[45] Date of Patent: Aug. 19, 1986

[54] RAIL SEAL

[75] Inventors: Owen G. Grant, Kitchener; Frank Williams, Waterloo, both of Canada

[73] Assignee: Epton Industries Inc., Kitchener, Canada

[21] Appl. No.: 643,687

[22] Filed: Aug. 23, 1984

[51] Int. Cl.[4] ..... E01C 9/04

[52] U.S. Cl. ..... 238/8; 33/180 R; 33/191; 238/381

[58] Field of Search ..... 238/6–9, 238/379–381; 33/180 R, 191; 116/30, 211

[56] References Cited

U.S. PATENT DOCUMENTS

| | | | |
|---|---|---|---|
| 1,598,584 | 8/1926 | Jones | 238/8 |
| 1,689,300 | 10/1928 | Rogers | 238/8 |
| 2,950,057 | 8/1960 | Speer | 238/8 |
| 4,212,108 | 7/1980 | Jackson | 33/180 R |
| 4,449,666 | 5/1984 | Hales et al. | 238/8 |
| 4,461,421 | 7/1984 | Maass | 238/8 |

FOREIGN PATENT DOCUMENTS

| | | | |
|---|---|---|---|
| 172157 | 1/1952 | Fed. Rep. of Germany | 238/8 |
| 1908832 | 1/1971 | Fed. Rep. of Germany | 238/8 |

*Primary Examiner*—Robert B. Reeves
*Assistant Examiner*—Donald T. Hajec
*Attorney, Agent, or Firm*—Ridout & Maybee

[57] ABSTRACT

The invention provides a seal for rails in a road level railbed comprising inner and outer resiliently flexible elongate members secured about each rail. The seal members are contoured to fit snugly against the inner and outer sides of a rail and are provided with a flexible membrane accommodating rail spike heads. The inner members have a groove to allow clearance of the flange of a railcar wheel and a flexible membrane extends beneath the groove. Movement of the flexible membrane in response to the railcar wheel flange breaks up silt and detritus which has a tendency to settle and pack hard in the flange groove. The movement of the flexible membrane also allows for deicing in the winter.

6 Claims, 3 Drawing Figures

RAIL SEAL

The present invention relates to improvements in flexible seals for railroad rails in a road level railbed such as at a railroad crossing. The purpose for using flexible rail seals in a road level railbed is to retard deterioration thereof caused primarily by railcar wheels which ride beyond the outer edge of the rail head thus causing breakage of the asphalt or other surrounding pavement material.

Previously known sealing members generally were utilized to seal only the outer side of the rails comprising the railbed, the inner sides thereof being equipped with rigid members to provide a structure which accommodated the flange of a railroad car wheel. Alternatively, the inner side of the rail could also be equipped with a flexible seal having a structure to allow for clearance of the wheel flange.

These prior seals functioned satisfactorily with respect to the outer side of the rail, but the structure applied to the inner side of the rail has been found to be potentially hazardous. The flange way groove for a rigid inner member tends to become clogged with hard packed detritus. Prior flexible inner seals were not provided with sufficient support to stand up under the influence of automobile and truck traffic passing over the road level railbed, and therefore, such seals break down causing blockage of the flange way groove. In both instances a hazardous situation is created which could result in a train derailment.

Installation of the prior flexible seals required the installer to modify the bottom surface of the seal to provide a snug fit about the heads of the spikes used to secure the rail to the wooden tie. Failure to properly gouge out the bottom surface of the seals to accommodate spike heads resulted in an uneven fit for the seal against the rail and hence reduced efficiency thereof. Modification of the bottom surface of the prior seals often allowed water to enter the interior voids of the seal member, and the freezing of such trapped water reduced the effectiveness of the seal. Also, installation of the flexible seals usually required securing thereof against the rail by means of spikes driven partially into the ties and bent over against the seal. The flexible seals are designed to provide optimum sealing efficiency when pegged in place by spikes or other similar means within a specific zone at the outer surface of the seal. It has been observed that improper placement of these retaining spikes at the outer surface of the seal is a common problem.

The prior seals were suitable for use at railroad level crossings comprising asphalt filling for the railbed, whereas the present seal may be used in road level railbeds comprising asphalt or wood or concrete planking as the fill material.

The present invention provides a flexible seal member for each side of the rail. Each seal member has a longitudinal bore extending therethrough near the bottom thereof defining a thin membrane which is readily displaced by and sealingly engages the spike heads used to secure the rail to the ties. Additionally, each seal has a colour coded zone along the outer surface thereof indicating the proper area for engagement of the retaining spikes.

Unlike the prior seals of this type, the present seal may be used in a railbed for high speed rail traffic. Thus, the present seal provides an inner rail side sealing member having a groove to accommodate passage of a railroad car wheel flange and a longitudinally extending bore through the member beneath the groove so as to define a membrane in the top surface of the member which allows rocks or other debris in the groove to be displaced readily downwardly by the wheel flange, and which encourages the breaking up of hard packed silt or detritus which may have accumulated in the groove. The inner sealing member of the present invention is provided with a structure designed to withstand the effects of crossing vehicle traffic so that the flange way groove will not become obstructed by a breakdown of the member itself.

Accordingly, the present invention provides a flexible seal for railroad rails in a road level crossing or other road level railbed, wherein at least two rails are mounted on a support structure, each rail having base, intermediate and head portions, and each pair of rails having inner sides facing one another and outer sides facing away from one another.

The seal comprises a first resiliently flexible elongate member extending longitudinally along the outer side of each rail. The first member has side and bottom surface portions contoured to fit snugly against the intermediate and base portions of the rail; a longitudinally ribbed top surface approximately level with the top of the rail from which depend inner and outer planar side surface portions, said planar inner side surface portion and said contoured side surface portion joining at a longitudinal groove positionable beneath the rail head, the planar outer side surface portion having a longitudinal groove therein toward the lower end thereof; at least two bores extending longitudinally therethrough providing compression chambers for the member; and a longitudinally extending bore near the bottom thereof defining a thin membrane capable of accommodating displacement along the bottom surface for rail spike heads or the like being spaced along the length of the rail.

The seal also comprises a second resiliently flexible elongate member extending longitudinally along the inner side of each rail. The second member has side and bottom surface portions contoured to fit snugly against the intermediate and base portions of the rail; a longitudinally ribbed top surface approximately level with the top of the rail and spaced therefrom by a concave top surface portion defining a longitudinally extending groove having a depth and width sufficient to accommodate the flange of a railroad car wheel; an outer surface having an upper planar portion and a lower concave portion defining a longitudinally extending groove; a first bore extending longitudinally therethrough beneath said concave top surface portion and having a width approximating that of the portion; and a second longitudinally extending bore near the bottom thereof defining a thin membrane capable of accommodating displacement along the bottom surface for rail spike heads or the like being spaced along the length of the rail.

A preferred embodiment will hereinafter be described with reference being made to the drawings in which.

Figure 1:
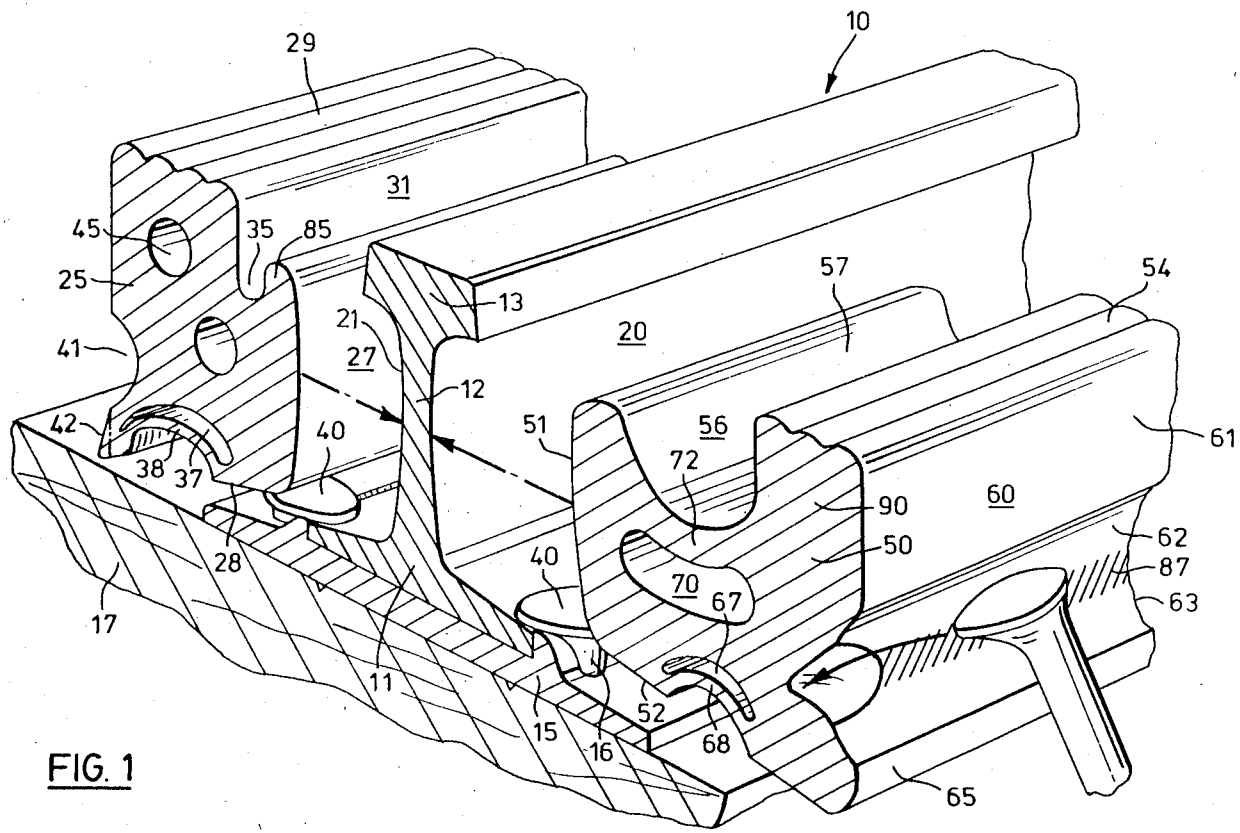
FIG. 1 is a perspective view, partially exploded, showing a section of railbed having the present seal members applied about a rail.

Referring to FIG. 1, a rail 10 having base, intermediate and head portions 11, 12 and 13 is secured in a railbed by means of a plate 15 and spikes 16 to a tie 17. The rail 10 comprises one of a pair of rails 10, and each pair of rails 10 has inner sides 20 facing one another and outer sides 21 facing away from one another.

A first resiliently flexible seal member 25 extends longitudinally along the outer side 21 of each rail 10. The seal 25 may be made from a rubber or a similar material, but is preferably made of EPDM rubber.

The first member 25 has a side surface 27 and bottom surface 28 contoured to fit snugly against the intermediate and base portions 12 and 11 of the rail 10. The member 25 has a longitudinally ribbed top surface 29 situated approximately level with the top of the rail head 13. Depending from the top surface 29 are inner and outer planar side surface portions 31 and 32. The planar inner side portion 31 and the contoured side surface portion 21 join at a longitudinal groove 35. The groove 35 is positionable beneath the rail head 13 and provides flexibility to the member 25 toward the top thereof so that a good fit for the member 25 is obtained about the rail head 13.

The first member 25 has a longitudinal bore 37 extending therethrough near the bottom 28 thereof defining a thin membrane 38. The membrane 38 is capable of flexing to accommodate displacement along the bottom surface 28 caused by heads 40 of the spikes 16. The planar outer surface portion 32 has a longitudinal groove 41 therein toward the lower end thereof. The groove 41 provides added flexibility to the bottom outer portion 42 of the member 25 so that the portion 42 may conform readily about the spike heads 40 and tie plates 15 thereby providing a good seal along the base 11 of the rail 10.

The first member 25 has at least two bores 45 extending longitudinally therethrough. The bores 45 provide compression chambers allowing the member 25 to flex in response to external pressures thereby reducing damage to the member 25 by vibration and shock from vehicle and railcar traffic and encouraging continuous snug engagement of the member 25 against the rail 10.

A second resiliently flexible seal member 50 extends longitudinally along the inner side 20 of each rail 10 in the railbed. The second member 50 may also be made from a rubber or similar material, but is preferably made of EPDM rubber.

The member 50 has a side surface 51 and a bottom surface 52 contoured to fit snugly against the intermediate and base portions 12 and 11 of the rail 10. The member 50 has a longitudinally ribbed top surface 54 situated approximately level with the top of the rail head 13 and spaced therefrom by a concave top surface portion 56 defining a longitudinally extending groove 57. The groove 57 has a width and depth sufficient to accommodate the flange of railroad car wheel.

The member 50 has an outer surface 60 comprising an upper planar portion 61 and a lower concave portion 62 which defines a longitudinally extending groove 63 therein. Below the groove 63 is a bottom outer portion 65. As with the first member 25, the second member 50 has a longitudinal bore 67 extending therethrough near the bottom surface 52 thereof defining a thin membrane 68. The membrane 68 is capable of flexing to accommodate displacement along the bottom surface 52 caused by the heads 40 of the spikes 16. The groove 63 provides added flexibility to the bottom outer portion 65 so that the portion 65 may conform readily about the spike heads 40 and tie plate 15 thereby providing a good seal along the bottom of the rail 10.

The member 50 has a bore 70 extending longitudinally therethrough beneath the concave top surface portion 56. The bore 70 has a width approximately that of the top surface portion 56 or the groove 57 defined thereby. The bore 70 thus defines a membrane 72 in the surface portion 56 which allows rocks or other debris in the groove 57 to be displaced readily downwardly by the railroad car wheel flange. Movement of the membrane 72 in response to the railcar wheel flange breaks up packed silt and detritus which has accumulated in the groove 57. Likewise, the groove 57 may be deiced in winter by this movement of the flexible membrane 72. By ensuring free passage of the flange of the railcar wheel, the danger of derailment especially under high speed conditions, is minimized.

Figure 2:
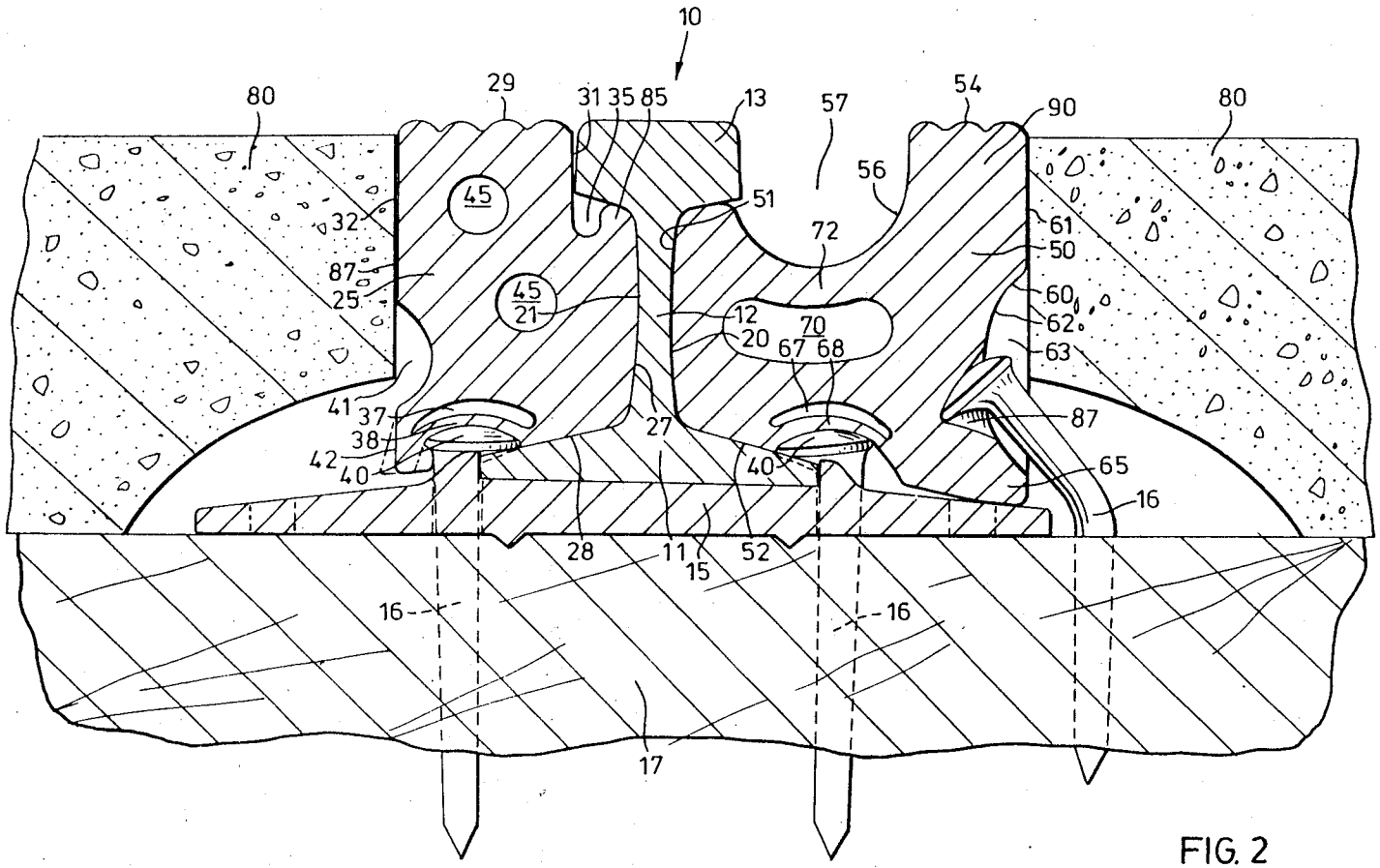
FIG. 2 is a cross sectional view of the rail seal members as installed in a level crossing having concrete planking.
Figure 3:
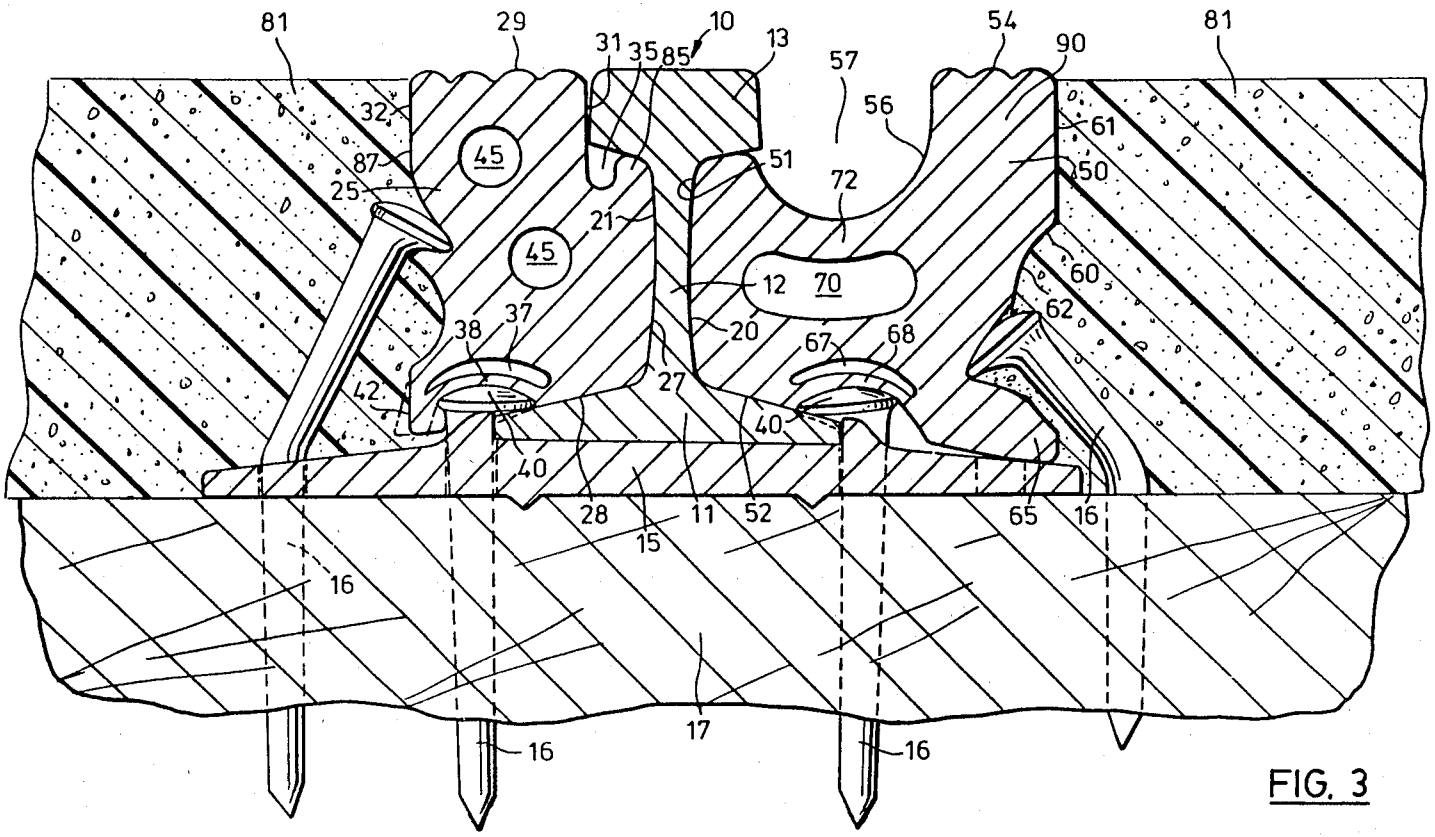
FIG. 3 is a cross sectional view of the rail seal members as installed in a level crossing having asphalt fill.

The present flexible rail seal is suitable for installation in road level railbeds filled with asphalt, or planking in the form of preformed concrete slabs or wood planks. Installation of the present seal in a railbed having concrete slabs 80 as fill is shown in FIG. 2, and an installation wherein asphalt 81 is used as fill is shown in FIG. 3.

The first and second seal members 25 and 50 are held in place against the rail 10 primarily by means of the fill material. When concrete planking 80 is used as shown in FIG. 2, a spike 16 is driven partially into the tie 17 adjacent the outside of the inner or second member 50 and then bent over to engage the member 50 at the outer groove 63. When the member 50 is pegged in place in this manner, the concrete slabs 80 can then be installed flush against the outer surface 60 of the member 50.

The outer or first member 25 cannot be pegged in place prior to installation of concrete planking because the spikes needed for proper pegging of the member 25 must engage the outer surface 32 at a point above the midpoint of the height thereof and would thus, provide an impediment to the flush engagement of the concrete planking 80 at the outer surface 32. However, the member 25 is designed to not require pegging along the outside thereof. The contoured inner surface 27 of the member 25 is shaped to be wedged between the head 13 and base 11 of the rail against the intermediate portion 12. A ridge 85 is defined at the top of the inner surface 27 of the member 25 between the surface 27 and the groove 35. This ridge 85 may be deformed in the direction of the groove 35 upon seating of the member 25 against the rail 10 thereby providing generally vertical tension along the inner surface 27 which holds the member 25 in place when the concrete slabs 80 or other planking is installed flush against the outer surface 32 of the member 25. In the case where asphalt or other poured fill is used, external pegging of the member 25 is preferred (see FIG. 3).

When applying bent spikes 16 to the outer surfaces of the members 25 and 50 during installation thereof, it is important that the spikes 16 engage the surfaces 32 and 60 within a specific zone to ensure that snug engagement of the members 25 and 50 against the rail 10 is achieved. In this regard, the outer surfaces 32 and 60 of the members 25 and 50 are preferably marked with a coloured stripe 87 indicating the zone of contact for the pegging spikes 16.

The preferred construction of the inner member 50 includes an upper portion 90 between the concave top surface 56 and outer surface 61 of sufficient thickness to provide resistance to displacement or bending of the upper portion 90 in toward the rail 10 by vehicle traffic passing over the road level railbed. This inward displacement of the upper portion 90 is potentially hazardous to the extent that obstruction of the groove 57 is caused thereby. This is especially true when the railbed is subject to high speed rail traffic. It has been found that a thickness for the portion 90 of about 2 inches between the outer surface 61 and the concave surface 56 toward the top surface 54 thereof to a thickness of more than 2 inches in accordance with the curvature of the surface 56 toward the base of portion 90 is sufficient to prevent collapse of the portion 90 so as to obstruct the groove 57.

It has been found that use of the present rail seal extends the life of the road level railbed many years beyond that for a railbed of conventional construction. It is felt that this result is due to the ability of the invention to flex so as to absorb vibration and shock imparted to the railbed by railroad and road vehicle traffic.

While the foregoing description has provided specifics of those features preferred, it should be understood that the present invention includes those modifications and variants apparent to one skilled in this art.

We claim:

1. A flexible seal for railroad rails in a road level crossing or other road level railbed, wherein at least two rails are mounted on a support structure, each rail having base, intermediate and head portions, and each pair of rails having inner sides facing one another and outer sides facing away from one another, the seal comprising:

a first resiliently flexible elongate member extending longitudinally along the outer side of each rail having:

side and bottom surface portions contoured to fit snugly against the intermediate and base portions of the rail;

a longitudinally ribbed top surface approximately level with the top of the rail from which depends an inner planar side surface portion, said planar inner side surface portion and said contoured side surface portion joining at a longitudinal groove positionable beneath the rail head; an outer side surface having an upper planar portion and a lower concave portion defining a lower outside longitudinally extending groove; at least two bores extending longitudinally therethrough providing compression chambers for the members; and a longitudinally extending bore near the bottom thereof defining a thin membrane capable of accommodating displacement along the bottom surface for rail spike heads or the like being spaced along the length of the rail; and a second resiliently flexible elongate member extending longitudinally along the inner side of each rail having:

side and bottom surface portions contoured to fit snugly against the intermediate and base portions of the rail;

a longitudinally ribbed top surface approximately level with the top of the rail and spaced therefrom by a concave top surface portion defining a longitudinally extending top groove having a depth and width sufficient to accommodate the flange of a railroad car wheel;

an outer side surface having an upper planar portion and a lower concave portion defining a lower outside longitudinally extending groove, the thickness of the second member between the upper planar portion of the outer surface and the concave top surface portion being sufficient to prevent collapse of the member under the influence of automobile and truck traffic passing over the road level railbed so as to obstruct the longitudinally extending top groove;

a first bore extending longitudinally therethrough beneath said concave top surface portion and having a width approximating that of the top surface portion, said bore defining a resilient membrane between the bore and concave top surface which allows for downward displacement by a railcar wheel flange, the resilient membrane thereby ensuring free passage of the railcar wheel flange along the longitudinally extending groove; and a second longitudinally extending bore near the bottom thereof defining a thin membrane capable of accommodating displacement along the bottom surface for rail spike heads or the like being spaced along the length of the rail.

2. A seal as claimed in claim 1, further comprising colour coded areas extending longitudinally along the outer surfaces of both first and second members, said areas identifying the locations for the application of means for securing the members in place.

3. A seal as claimed in claim 1, wherein said thickness of the second member between the upper planar portion of the outer surface and the concave top surface portion is approximately two inches at the narrowest part thereof.

4. A seal as claimed in claim 1, wherein said members are made from EPDM rubber.

5. A seal as claimed in claim 1, wherein the road level railbed is filled with asphalt.

6. A seal as claimed in claim 1, wherein the road level railbed is filled with planking.

* * * * *